US006698206B2

(12) United States Patent
Scarinci et al.

(10) Patent No.: US 6,698,206 B2
(45) Date of Patent: Mar. 2, 2004

(54) COMBUSTION CHAMBER

(75) Inventors: Thomas Scarinci, Quebec (CA); Ivor J Day, Cambridge (GB); Christopher Freeman, Nottingham (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 10/330,854

(22) Filed: Dec. 27, 2002

(65) Prior Publication Data

US 2003/0145576 A1 Aug. 7, 2003

Related U.S. Application Data

(62) Division of application No. 09/733,960, filed on Feb. 27, 2001, now Pat. No. 6,532,742.

(30) Foreign Application Priority Data

Dec. 16, 1999 (GB) ..... 9929601

(51) Int. Cl.[7] ..... F02C 7/00
(52) U.S. Cl. ..... 60/725; 60/737
(58) Field of Search ..... 60/725, 737, 738

(56) References Cited

U.S. PATENT DOCUMENTS 4,928,481 A * 5/1990 Joshi et al. ..... 60/737
5,235,814 A * 8/1993 Leonard ..... 60/738

* cited by examiner

*Primary Examiner*—Louis J. Casaregola
(74) *Attorney, Agent, or Firm*—W. Warren Taltavull; Manelli Denison & Selter PLLC

(57) ABSTRACT

A three-stage lean burn combustion chamber (28) comprises a primary combustion zone (36), a secondary combustion zone (40) and a tertiary combustion zone (44). Each of the combustion zones (36,40,44) is supplied with premixed fuel and air by respective fuel and air mixing ducts (54,70,92). The fuel and air mixing ducts (54,70,92) have a plurality of air injections apertures (62,64,76,98) spaced apart in the direction of flow through the fuel and air mixing ducts (54,70,92). The apertures (62,64,76,98) reduce the magnitude of the fluctuations in the fuel to air ratio of the fuel and air mixture supplied into the at least one combustion zone (36,40,44). This reduces the generation of harmful vibrations in the combustion chamber (28).

10 Claims, 7 Drawing Sheets

COMBUSTION CHAMBER

This is a Divisional of application Ser. No. 09/733,960 Feb. 27, 2001 now U.S. Pat. No. 6,532,742.

FIELD OF THE INVENTION

The present invention relates generally to a combustion chamber, particularly to a gas turbine engine combustion chamber.

BACKGROUND ON THE INVENTION

In order to meet the emission level requirements, for industrial low emission gas turbine engines, staged combustion is required in order to minimise the quantity of the oxide of nitrogen (NOx) produced. Currently the emission level requirement is for less than 25 volumetric parts per million of NOx for an industrial gas turbine exhaust. The fundamental way to reduce emissions of nitrogen oxides is to reduce the combustion reaction temperature, and this requires premixing of the fuel and a large proportion, preferably all, of the combustion air before combustion occurs. The oxides of nitrogen (NOx) are commonly reduced by a method, which uses two stages of fuel injection. Our UK patent no. GB1489339 discloses two stages of fuel injection. Our International patent application no. WO92/07221 discloses two and three stages of fuel injection. In staged combustion, all the stages of combustion seek to provide lean combustion and hence the low combustion temperatures required to minimise NOx. The term lean combustion means combustion of fuel in air where the fuel to air ratio is low, i.e. less than the stoichiometric ratio. In order to achieve the required low emissions of NOx and CO it is essential to mix the fuel and air uniformly.

The industrial gas turbine engine disclosed in our International patent application no. WO92/07221 uses a plurality of tubular combustion chambers, whose axes are arranged in generally radial directions. The inlets of the tubular combustion chambers are at their radially outer ends, and transition ducts connect the outlets of the tubular combustion chambers with a row of nozzle guide vanes to discharge the hot gases axially into the turbine sections of the gas turbine engine. Each of the tubular combustion chambers has two coaxial radial flow swirlers, which supply a mixture of fuel and air into a primary combustion zone. An annular secondary fuel and air mixing duct surrounds the primary combustion zone and supplies a mixture of fuel and air into a secondary combustion zone.

One problem associated with gas turbine engines is caused by pressure fluctuations in the air, or gas, flow through the gas turbine engine. Pressure fluctuations in the air, or gas, flow through the gas turbine engine may lead to severe damage, or failure, of components if the frequency of the pressure fluctuations coincides with the natural frequency of a vibration mode of one or more of the components. These pressure fluctuations may be amplified by the combustion process and under adverse conditions a resonant frequency may achieve sufficient amplitude to cause severe damage to the combustion chamber and the gas turbine engine.

It has been found that gas turbine engines, which have lean combustion, are particularly susceptible to this problem. Furthermore it has been found that as gas turbine engines which have lean combustion reduce emissions to lower levels by achieving more uniform mixing of the fuel and the air, the amplitude of the resonant frequency becomes greater.

It is believed that the pressure fluctuations in the gas turbine engine produce fluctuations in the fuel to air ratio at the exit of the fuel and air mixing ducts.

SUMMARY OF THE INVENTION

Accordingly the present invention seeks to provide a combustion chamber which reduces or minimises the above-mentioned problem.

Accordingly the present invention provides a combustion chamber comprising at least one combustion zone defined by at least one peripheral wall, at least one fuel and air mixing duct for supplying a fuel and air mixture to the at least one combustion zone, the at least one fuel and air mixing duct having an upstream end and a downstream end, fuel injection means for supplying fuel into the at least one fuel and air mixing duct, air injection means for supplying air into the at least one fuel and air mixing duct, the pressure of the air supplied to the at least one fuel and air mixing duct fluctuating, the air injection means comprising a plurality of air injectors spaced apart in the direction of flow through the at least one fuel and air mixing duct to reduce the magnitude of the fluctuations in the fuel to air ratio of the fuel and air mixture supplied into the at least one combustion zone.

Preferably the at least one fuel and air mixing duct comprises at least one wall, the air injectors comprise a plurality of apertures extending through the wall.

Preferably the combustion chamber comprises a primary combustion zone and a secondary combustion zone downstream of the primary combustion zone.

Preferably the combustion chamber comprises a primary combustion zone, a secondary combustion zone downstream of the primary combustion zone and a tertiary combustion zone downstream of the secondary combustion zone.

The at least one fuel and air mixing duct may supply fuel and air into the primary combustion zone. The at least one fuel and air mixing duct may supply fuel and air into the secondary combustion zone. The at least one fuel and air mixing duct may supply fuel and air into the tertiary combustion zone.

The at least one fuel and air mixing duct may comprise a single annular fuel and air mixing duct, the air injection means being axially spaced apart. The annular fuel and air mixing duct may comprise an inner annular wall and an outer annular wall, the air injector means being provided in at least one of the inner and outer annular walls. The air injector means may be arranged in the inner and outer annular walls.

Preferably the fuel and air mixing duct comprises a radial fuel and air mixing duct, the air injection means being radially spaced apart. Preferably the radial fuel and air mixing duct comprises a first radial wall and a second radial wall, the air injector means being provided in at least one of the first and second radial walls. Preferably the air injector means are provided in the first and second radial walls.

Alternatively the fuel and air mixing duct comprises a tubular fuel and air mixing duct, the air injector means being axially spaced apart.

Preferably the fuel injector means is arranged at the upstream end of the fuel and air mixing duct and the air injector means are arranged downstream of the fuel injector means.

Alternatively the fuel injector means is arranged between the upstream end and the downstream end of the at least one fuel and air mixing duct, some of the air injector means are arranged upstream of the fuel injector means and some of the air injector means are arranged downstream of the fuel injector means.

Preferably each air injector means at the downstream end of the fuel and air mixing duct is arranged to supply more air into the fuel and air mixing duct than each air injector means at the upstream end of the fuel and air mixing duct.

Preferably each air injector means at a first position in the direction of flow through the fuel and air mixing duct is arranged to supply more air into the fuel and air mixing duct than each air injector means upstream of the first position in the fuel and air mixing duct.

Preferably each air injector means at the first position in the fuel and air mixing duct is arranged to supply less air into the fuel and air mixing duct than each air injector means downstream of the first position in the fuel and air mixing duct.

Preferably the volume of the fuel and air mixing duct being arranged such that the average travel time from the fuel injection means to the downstream end of the fuel and air mixing duct is greater than the time period of the fluctuation.

Preferably the volume of the fuel and air mixing duct being arranged such that the length of the fuel and air mixing duct multiplied by the frequency of the fluctuations divided by the velocity of the fuel and air leaving the downstream end of the fuel and air mixing duct is at least two.

Preferably the plurality of air injectors are spaced apart in the direction of flow through the at least one fuel and air mixing duct over a length equal to half the wavelength of the fluctuations of the air supplied to the at least one fuel and air mixing duct.

Preferably the at least one fuel and air mixing duct comprises a swirler. Preferably the swirler is a radial flow swirler.

The present invention also provides a fuel and air mixing duct for a combustion chamber, the fuel and air mixing duct comprising fuel injection means for supplying fuel into the fuel and air mixing duct, air injection means for supplying air into the fuel and air mixing duct, the air injection means comprising a plurality of air injectors spaced apart in the direction of flow through the fuel and air mixing duct.

BRIEF DESCRIPTION OF THE DRAWINGS

The present invention will be more fully described by way of example with reference to the accompanying drawings, in which.

DETAILED DESCRIPTION OF THE INVENTION

Figure 1:
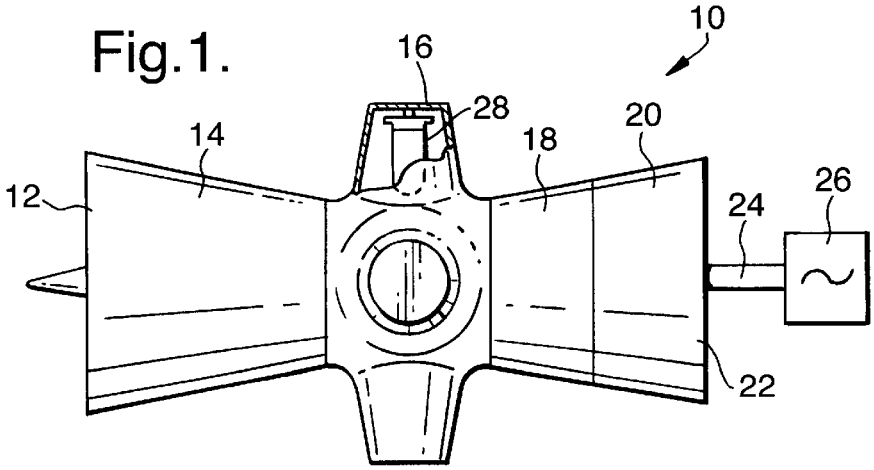
FIG. 1 is a view of a gas turbine engine having a combustion chamber according to the present invention.

An industrial gas turbine engine 10, shown in FIG. 1, comprises in axial flow series an inlet 12, a compressor section 14, a combustion chamber assembly 16, a turbine section 18, a power turbine section 20 and an exhaust 22. The turbine section 20 is arranged to drive the compressor section 14 via one or more shafts (not shown). The power turbine section 20 is arranged to drive an electrical generator 26 via a shaft 24. However, the power turbine section 20 may be arranged to provide drive for other purposes. The operation of the gas turbine engine 10 is quite conventional, and will not be discussed further.

Figure 3:
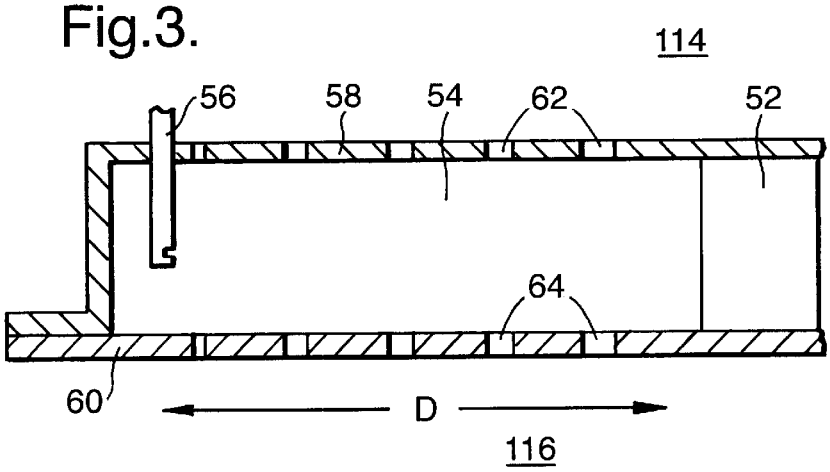
FIG. 3 is an enlarged cross-sectional view of part of the primary fuel and air mixing duct shown in FIG. 2.
Figure 4:
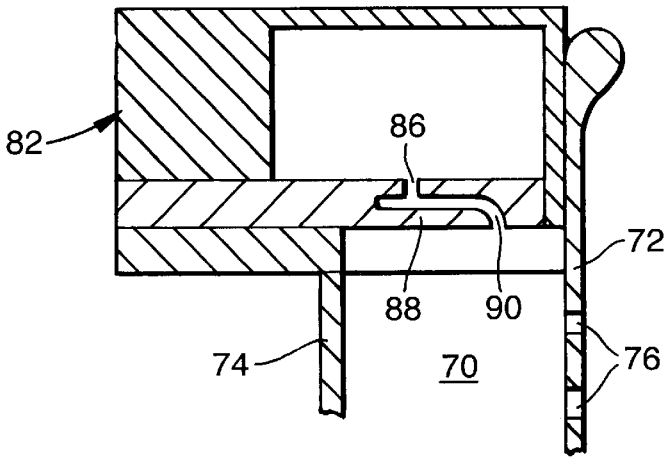
FIG. 4 is an enlarged cross-sectional view of part of the secondary fuel and air mixing duct shown in FIG. 2.
Figure 2:
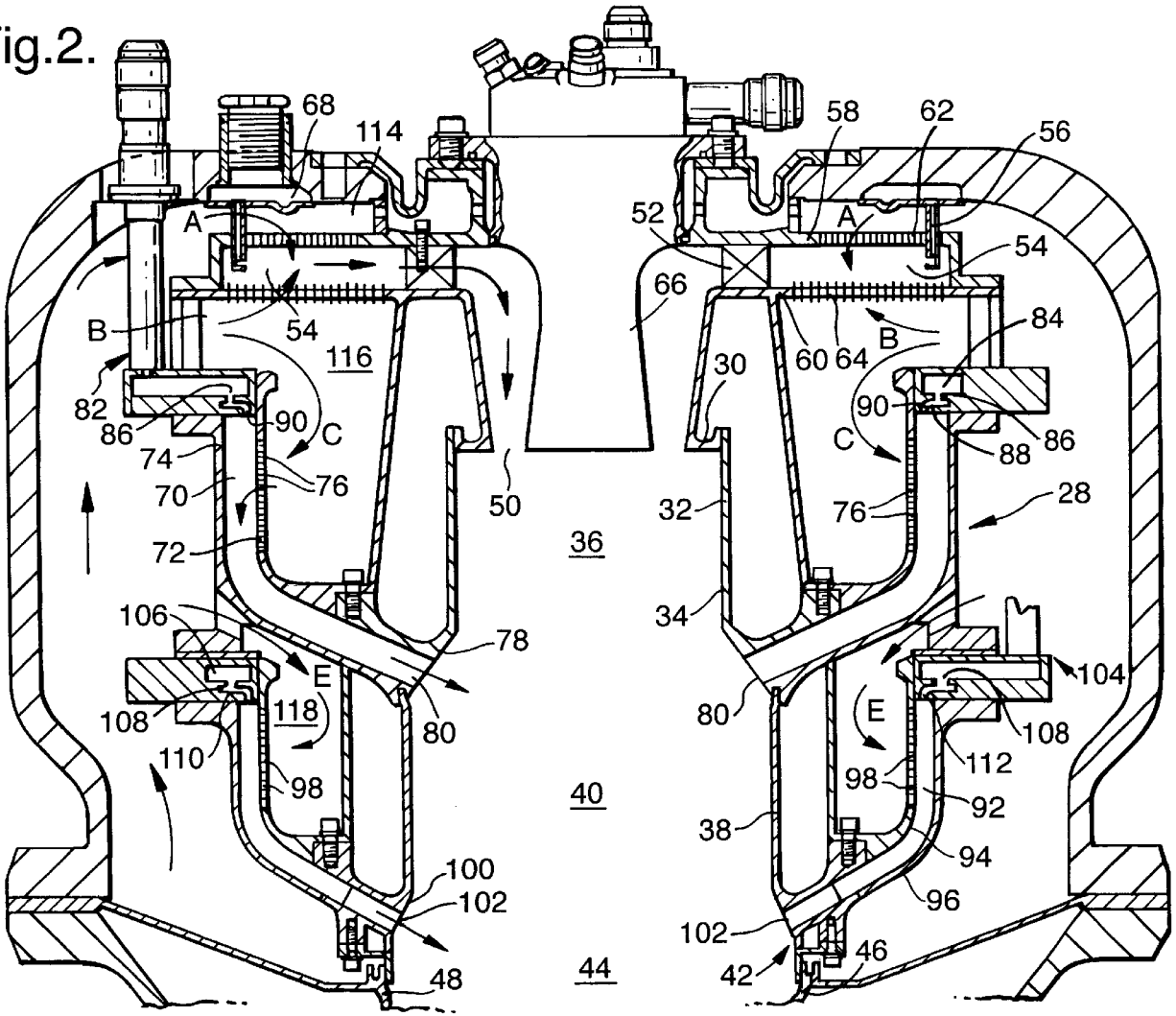
FIG. 2 is an enlarged longitudinal cross-sectional view through the combustion chamber shown in FIG. 1.

The combustion chamber assembly 16 is shown more clearly in FIGS. 2, 3 and 4. The combustion chamber assembly 16 comprises a plurality of, for example nine, equally circumferentially spaced tubular combustion chambers 28. The axes of the tubular combustion chambers 28 are arranged to extend in generally radial directions. The inlets of the tubular combustion chambers 28 are at their radially outermost ends and their outlets are at their radially innermost ends.

Each of the tubular combustion chambers 28 comprises an upstream wall 30 secured to the upstream end of an annular wall 32. A first, upstream, portion 34 of the annular wall 32 defines a primary combustion zone 36, a second, intermediate, portion 38 of the annular wall 32 defines a secondary combustion zone 40 and a third, downstream, portion 42 of the annular wall 32 defines a tertiary combustion zone 44. The second portion 38 of the annular wall 32 has a greater diameter than the first portion 34 of the annular wall 32 and similarly the third portion 42 of the annular wall 32 has a greater diameter than the second portion 38 of the annular wall 32.

A plurality of equally circumferentially spaced transition ducts 46 are provided, and each of the transition ducts 46 has a circular cross-section at its upstream end 48. The upstream end 48 of each of the transition ducts 46 is located coaxially with the downstream end of a corresponding one of the tubular combustion chambers 28, and each of the transition ducts 46 connects and seals with an angular section of the nozzle guide vanes.

The upstream wall 30 of each of the tubular combustion chambers 28 has an aperture 50 to allow the supply of air and fuel into the primary combustion zone 36. A radial flow swirler 52 is arranged coaxially with the aperture 50 in the upstream wall 30.

A plurality of fuel injectors 56 are positioned in a primary fuel and air mixing duct 54 formed upstream of the radial flow swirler 52. The walls 58 and 60 of the primary fuel and air mixing duct 54 are provided with a plurality of radially, and circumferentially, spaced apertures 62 and 64 respectively which form a primary air intake to supply air into the primary fuel and air mixing duct 54. The radially spaced apertures 62 and 64 are thus spaced apart longitudinally, in the direction of flow, of the primary fuel and air mixing duct 54 over a distance D. The apertures 62 may be circular or slots.

A central pilot igniter 66 is positioned coaxially with the aperture 50. The pilot igniter 66 defines a downstream portion of the primary fuel and air mixing duct 54 for the flow of the fuel and air mixture from the radial flow swirler 52 into the primary combustion zone 36. The pilot igniter 66 turns the fuel and air mixture flowing from the radial flow swirler 52 from a radial direction to an axial direction. The primary fuel and air is mixed together in the primary fuel and air mixing duct 54.

The fuel injectors 56 are supplied with fuel from a primary fuel manifold 68.

An annular secondary fuel and air mixing duct 70 is provided for each of the tubular combustion chambers 28. Each secondary fuel and air mixing duct 70 is arranged circumferentially around the primary combustion zone 36 of the corresponding tubular combustion chamber 28. Each of the secondary fuel and air mixing ducts 70 is defined between a second annular wall 72 and a third annular wall 74. The second annular wall 72 defines the inner extremity of the secondary fuel and air mixing duct 70 and the third annular wall 74 defines the outer extremity of the secondary fuel and air mixing duct 70. The second annular wall 72 of the secondary fuel and air mixing duct 70 has a plurality of axially and circumferentially spaced apertures 76 which form a secondary air intake to the secondary fuel and air mixing duct 70. The apertures 76 are spaced apart axially, longitudinally in the direction of flow, of the secondary fuel and air mixing duct 70. The apertures 76 may be circular or slots.

At the downstream end of the secondary fuel and air mixing duct 70, the second and third annular walls 72 and 74 respectively are secured to a frustoconical wall portion 78 interconnecting the wall portions 34 and 38. The frustoconical wall portion 78 is provided with a plurality of apertures 80. The apertures 80 are arranged to direct the fuel and air mixture into the secondary combustion zone 40 in a downstream direction towards the axis of the tubular combustion chamber 28. The apertures 80 may be circular or slots and are of equal flow area.

The secondary fuel and air mixing duct 70 reduces in cross-sectional area from the intake 76 at its upstream end to the apertures 80 at its downstream end. The shape of the secondary fuel and air mixing duct 70 produces a constantly accelerating flow through the duct 70.

A plurality of secondary fuel systems 82 are provided, to supply fuel to the secondary fuel and air mixing ducts 70 of each of the tubular combustion chambers 28. The secondary fuel system 82 for each tubular combustion chamber 28 comprises an annular secondary fuel manifold 84 arranged coaxially with the tubular combustion chamber 28 at the upstream end of the secondary fuel and air mixing duct 70 of the tubular combustion chamber 28. Each secondary fuel manifold 84 has a plurality, for example thirty two, of equi-circumferentially-spaced secondary fuel apertures 86. Each of the secondary fuel apertures 86 directs the fuel axially of the tubular combustion chamber 28 onto an annular splash plate 88. The fuel flows from the splash plate 88 through an annular passage 90 in a downstream direction into the secondary fuel and air mixing duct 70 as an annular sheet of fuel.

An annular tertiary fuel and air mixing duct 92 is provided for each of the tubular combustion chambers 28. Each tertiary fuel and air mixing duct 92 is arranged circumferentially around the secondary combustion zone 40 of the corresponding tubular combustion chamber 28. Each of the tertiary fuel and air mixing ducts 92 is defined between a fourth annular wall 94 and a fifth annular wall 96. The fourth annular wall 94 defines the inner extremity of the tertiary fuel and air mixing duct 92 and the fifth annular wall 96 defines the outer extremity of the tertiary fuel and air mixing duct 92. The tertiary fuel and air mixing duct 92 has a plurality of axially and circumferentially spaced apertures 98 which form a tertiary air intake to the tertiary fuel and air mixing duct 92. The apertures 98 are spaced apart axially, longitudinally in the direction of flow, of the tertiary fuel and air mixing duct 92 in the fourth annular wall 94. The apertures 98 may be circular or slots.

At the downstream end of the tertiary fuel and air mixing duct 92, the fourth and fifth annular walls 94 and 96 respectively are secured to a frustoconical wall portion 100 interconnecting the wall portions 38 and 42. The frustoconical wall portion 100 is provided with a plurality of apertures 102. The apertures 102 are arranged to direct the fuel and air mixture into the tertiary combustion zone 44 in a downstream direction towards the axis of the tubular combustion chamber 28. The apertures 102 may be circular or slots and are of equal flow area.

The tertiary fuel and air mixing duct 92 reduces in cross-sectional area from the intake 98 at its upstream end to the apertures 102 at its downstream end. The shape of the tertiary fuel and air mixing duct 92 produces a constantly accelerating flow through the duct 92.

A plurality of tertiary fuel systems 104 are provided, to supply fuel to the tertiary fuel and air mixing ducts 92 of each of the tubular combustion chambers 28. The tertiary fuel system 104 for each tubular combustion chamber 28 comprises an annular tertiary fuel manifold 106 positioned at the upstream end of the tertiary fuel and air mixing duct 92. Each tertiary fuel manifold 106 has a plurality, for example thirty two, of equi-circumferentially spaced tertiary fuel apertures 108. Each of the tertiary fuel apertures 108 directs the fuel axially of the tubular combustion chamber 28 onto an annular splash plate 110. The fuel flows from the splash plate 110 through the annular passage 112 in a downstream direction into the tertiary fuel and air mixing duct 92 as an annular sheet of fuel.

As discussed previously the fuel and air supplied to the combustion zones is premixed and each of the combustion zones 36, 40 and 44 is arranged to provide lean combustion to minimise NOx. The products of combustion from the primary combustion zone 36 flow into the secondary combustion zone 40 and the products of combustion from the secondary combustion zone 40 flow into the tertiary combustion zone 44.

Some of the air, indicated by arrow A, for primary combustion flows to a chamber 114 and this flow through the apertures 62 in wall 58 into the primary fuel and air mixing duct 54. The remainder of the air, indicated by arrow B, for primary combustion flows to a chamber 116 and this flow through the apertures 60 in wall 56 into the primary fuel and air mixing duct 54. The air, indicated by arrow C, for secondary combustion flows to the chamber 116 and this flow through the apertures 76 in wall 72 into the secondary fuel and air mixing duct 70. The air, indicated by arrow E, for tertiary combustion flows to the chamber 118 and this flow through the apertures 98 in wall 94 into the tertiary fuel and air mixing duct 92.

The combustion process amplifies the pressure fluctuations for the reasons discussed previously and may cause components of the gas turbine engine to become damaged if they have a natural frequency of a vibration mode coinciding with the frequency of the pressure fluctuations.

The pressure fluctuations, or pressure waves, in the combustion chamber produce fluctuations in the fuel to air ratio at the exit of the fuel and air mixing ducts. The pressure fluctuations in the airflow and the constant supply of fuel into the fuel and air mixing ducts of the tubular combustion chambers results in the fluctuating fuel to air ratio at the exit of the fuel and air mixing ducts.

Consider the equation:

$$\Delta u/U=1/M\times\Delta p/P$$

Where U is the velocity of the air, M is the mass, P is the pressure, Δu is the change in velocity, Δp is the change in pressure, FAR is the fuel to air ratio and Δ(FAR) is the change in the fuel to air ratio.

Thus in a typical fuel and air mixing duct, if Δp/P is about 1%, then Δu/U is about 30% and hence the Δ(FAR)/FAR is about 30% into the combustion chamber.

Figure 11:
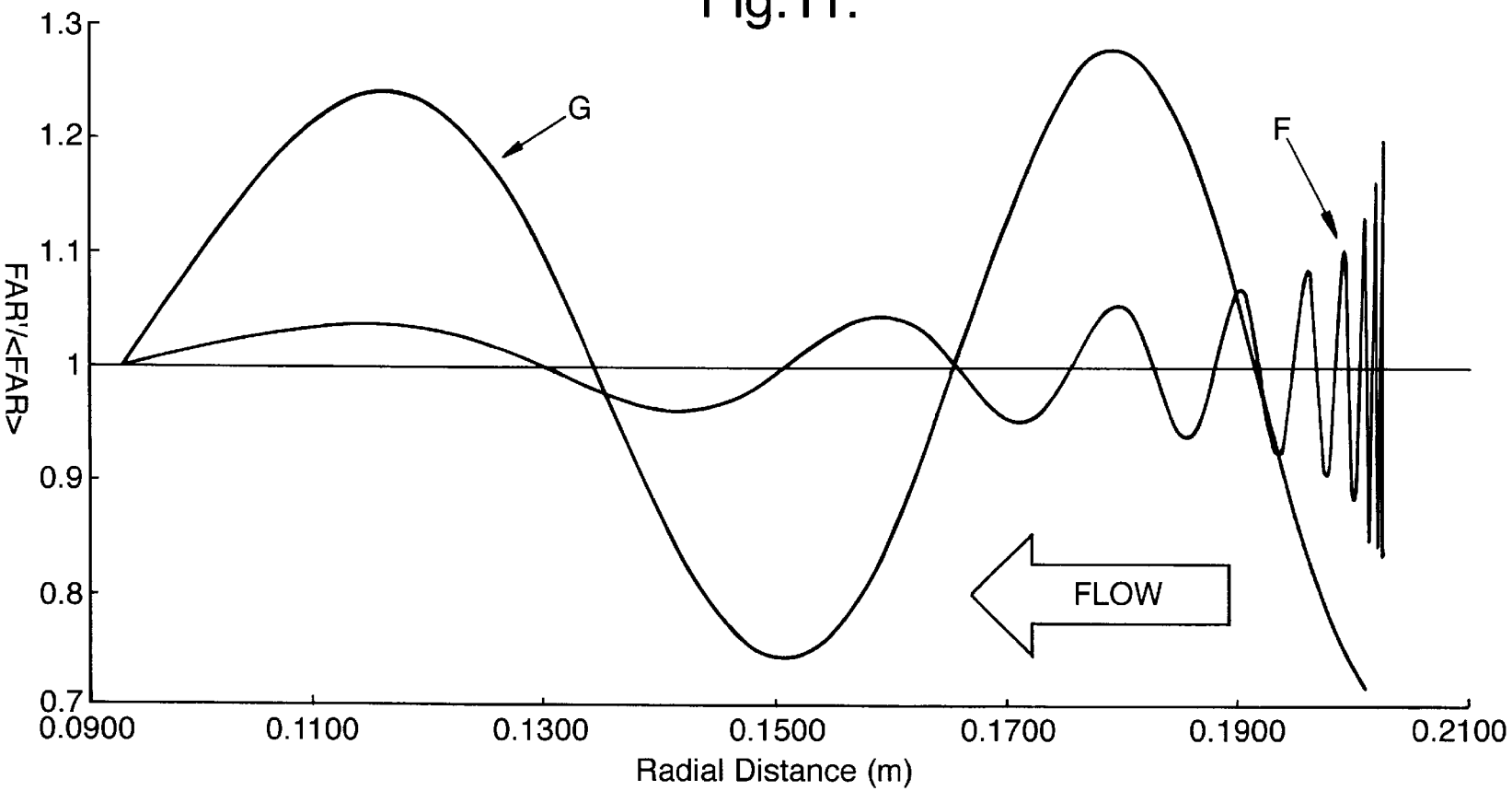
FIG. 11 is a graph comparing the fuel to air ratio fluctuation with radial distance in a radial flow fuel and air mixing duct according to the present invention and a radial flow fuel and air mixing duct according to the prior art.

The present invention seeks to provide a fuel and air mixing duct which supplies a mixture of fuel and air into the combustion chamber at a more constant fuel to air ratio. The present invention provides at least one point of fuel injection into the fuel and air mixing duct and a plurality of points of air injection into the fuel and air mixing duct. The air injection points are spaced apart longitudinally in the direction of flow of the fuel and air mixing duct. The pressure of the air at the longitudinally spaced air injection points at any instant in time is different. Thus as the fuel and air mixture flows along the fuel and air mixing duct the fuel and air mixture becomes weaker due to the additional air. More importantly the maximum difference between the actual fuel to air ratio and the average fuel to air ratio becomes relatively low, see line F in FIG. 11. However for a single fuel injection point and a single air injection point the maximum difference between the actual fuel to air ratio and the average fuel to air ratio remains relatively high, see line G in FIG. 11.

Figure 12:
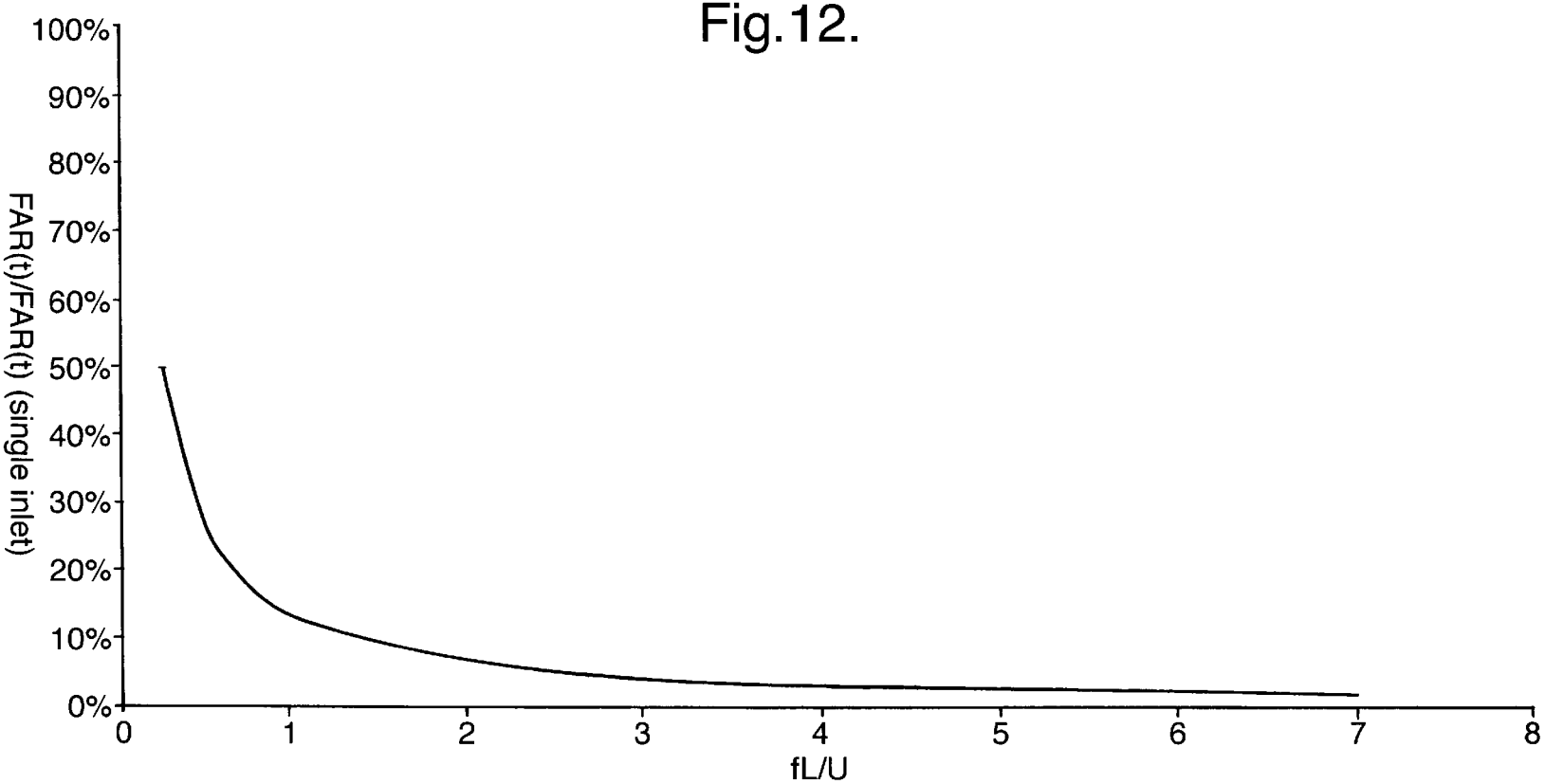
FIG. 12 is a graph of the fuel to air ratio of a fuel and air mixing duct according to the present invention divided by the fuel to air ratio of a fuel and air mixing duct according to the prior art against the frequency of fluctuation multiplied by the length of the fuel and air mixing duct divided by the velocity of the fuel and air mixture leaving the fuel and air mixing duct.

Calculations show, see FIG. 12, that the variation in the fuel to air ratio for a fuel and air mixing duct with a single fuel injection point and multiple air injection points are a few percent of the variation in the fuel to air ratio for a fuel and air mixing duct with a single fuel injection point and a single air injection point if the volume of the fuel and air mixing duct is such that the following equation is satisfied $$LF/U>X$$

Where L is the length of the fuel and air mixing duct, F is the frequency, U is the exit velocity of the fuel and air mixture and X is a number greater than 2. The greater the number X, the lower the variation in the fuel to air ratio. For example with X=2, the variation is about 7%, for X=3, the variation is about 4%, for X=4, the variation is about 3%. Preferably X is a number greater than 3, more preferably X is a number greater than 4 and more preferably X is a number greater than 5.

The progressive introduction of air along the length of the fuel and air mixing duct results in a number of physical mechanisms which contribute to the reduction, preferably elimination, of the pressure fluctuations, pressure waves or instabilities, in the combustion chamber. The physical mechanisms are the creation of a low velocity region, integration of the fuel to air ratio fluctuations, residence time distribution, damping of pressure waves and destruction of phase relationships.

The airflow in the vicinity of the fuel injector experiences fluctuations in its bulk velocity due to the pressure fluctuations in the fuel and air mixing duct. This creates a local fluctuation in fuel concentration, a local fuel to air ratio, which then flows downstream at the bulk velocity of the air in the fuel and air mixing duct. Due to the mixing of the fuel and air in the fuel and air mixing duct these fuel to air ratio fluctuations normally diffuse out, although the process is quite slow. However, if the local convective velocity is low and the local turbulent intensity is high, as in the present invention, any fuel to air ratio fluctuations are substantially dissipated by the time the fuel to air ratio fluctuations reach the combustion chamber. Hence, the combination of low velocity and high turbulence by the air injectors allows the mixing of the fuel and air to smooth out any fluctuations in the fuel concentration, fuel to air ratio, in the vicinity of the fuel injector.

Any fluctuation in the local fuel to air ratio in the vicinity of the fuel injector flows downstream and the progressive introduction of air along the length of the fuel and air mixing duct integrates out any fluctuations in the local fuel to air ratio due to the fuel injector. This is because the pressure of the air supplied from each of the air injectors fluctuates with time. If the average time of travel of a fluid particle from the vicinity of the fuel injector to the downstream end of the fuel and air mixing duct is longer than the time period of the pressure fluctuations, then the fluid particle originating from the vicinity of the fuel injector is subjected to a number of cycles of becoming leaner and richer that average out the initial fuel concentration fluctuation. This determines the spatial extent of the air injectors, i.e. the length D of the fuel and air mixing duct containing air injectors. This also determines the width, or cross-sectional area, of the fuel and air mixing duct as this affects the total residence time in the fuel and air mixing duct.

A clearly defined and dominant time delay between the fuel injector and the location of heat release in the combustion chamber is one mechanism for combustion instability. The presence of intense turbulent mixing in the fuel and air mixing duct, created by the longitudinally spaced air injectors, creates a large number of possible paths for a fuel particle to travel to the location of heat release. Associated with the large number of possible paths is an equally large number of possible residence times in the fuel and air mixing duct. The probability of the residence time in the fuel and air mixing duct follows an exponential distribution shifted by a certain delay time. This wide distribution of time delays, random in nature, makes it difficult for the system to maintain a coherent fuel to air ratio fluctuation of a large number of cycles and hence this makes resonant behaviour difficult to achieve. The residence time distribution is adjusted to prevent auto ignition of the fuel and air mixture in the fuel and air mixing duct.

The average air velocity is chosen so that the air injectors are sensitive to pressure fluctuations originating in the combustion chamber. As a pressure wave propagates from the downstream end of the fuel and air mixing duct towards the fuel injector it progressively loses amplitude because energy is used fluctuating the air pressure in the air injectors. This reduces the possibility of the pressure fluctuations producing a local fuel to air ratio fluctuation in the vicinity of the fuel injector. This also completely changes the coupling between the interior and exterior of the combustion chamber.

A consistent relationship is required between the pressure fluctuations inside the combustion chamber and the fluctuations in the chemical energy supplied to the combustion chamber in order for the occurrence of combustion instability. The chemical energy input to the combustion chamber is proportional to the strength of the fuel and air mixture supplied to the combustion chamber and the air velocity at the exit of the fuel and air mixing duct. The plurality of air injectors integrate out the pressure fluctuations and the fluctuations in the strength of the fuel and air mixture. Also any fuel to air ratio fluctuations present at the downstream end of the fuel and air mixing duct are uncorrelated with the pressure fluctuations that produced them. The possibility of positive reinforcement of pressure fluctuations or fuel to air ratio fluctuations is reduced.

The average bulk velocity increases along the length of the fuel and air mixing duct. Therefore it is necessary to progressively increase the cross-sectional area of the air injectors along the length of the fuel and air mixing duct to ensure sufficient penetration and mixing in the fuel and air mixing duct.

Figure 5:
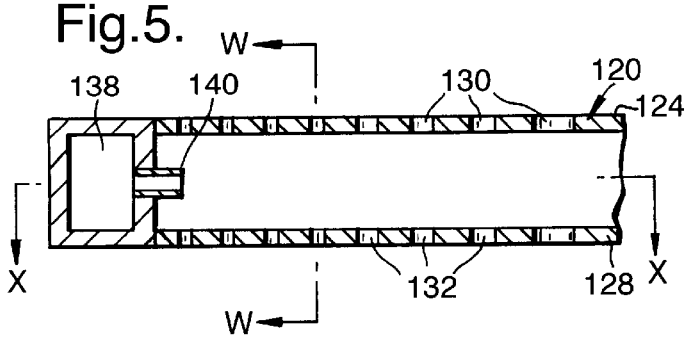
FIG. 5 is a cross-sectional view of an alternative fuel and air mixing duct.
Figure 6:
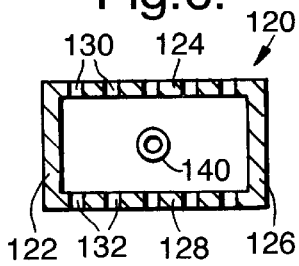
FIG. 6 is a cross-sectional view in the direction of arrows W—W in FIG. 5.
Figure 7:
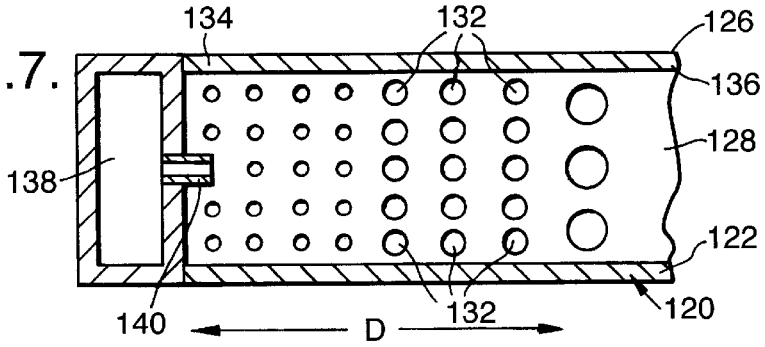
FIG. 7 is a cross-sectional view in the direction of arrows X—X in FIG. 5.

Another fuel and air mixing duct 120 according to the present invention is shown in FIGS. 5, 6 and 7. A rectangular cross-section fuel and air mixing duct 120 comprises four sidewalls 122, 124, 126 and 128. The walls 124 and 126 have a plurality of longitudinally and transversely spaced apertures 130 and 132 respectively which form an air intake to the fuel and air mixing duct 120. The apertures 130 and 132 progressively increase in cross-sectional area between the upstream end 134 of the fuel and air mixing duct 120 and the downstream end 136 of the fuel and air mixing duct 120. A single fuel injector 140 is provided to supply fuel into the upstream end 134 of the fuel and air mixing duct 120. The fuel injector 140 is supplied with fuel from a fuel manifold 138.

Figure 8:
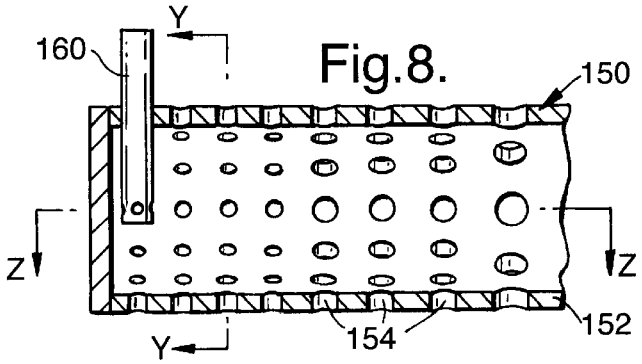
FIG. 8 is a cross-sectional view of an alternative fuel and air mixing duct.
Figure 9:
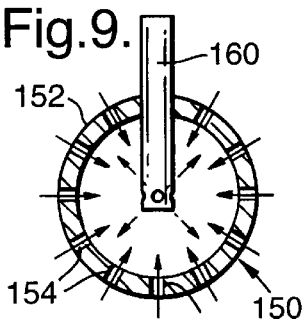
FIG. 9 is a cross-sectional view in the direction of arrows Y—Y in FIG. 8.
Figure 10:
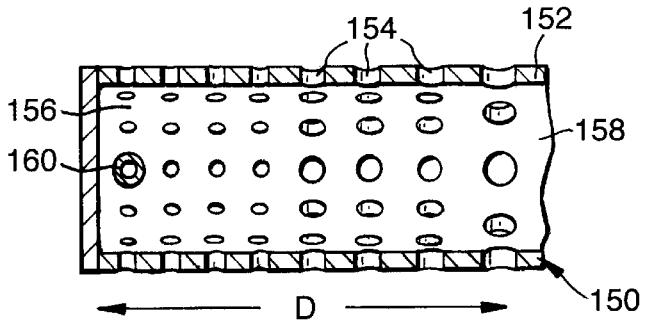
FIG. 10 is a cross-sectional view in the direction of arrows Z—Z in FIG. 8.

A further fuel and air mixing duct 150 according to the present invention is shown in FIGS. 8, 9 and 10. A circular cross-section fuel and air mixing duct 150 comprises a tubular wall 152 which has a plurality of axially and circumferentially spaced apertures 154 which form an air intake to the fuel and air mixing duct 150. The apertures 154 progressively increase in cross-sectional area between the upstream end 156 of the fuel and air mixing duct 120 and the downstream end 158 of the fuel and air mixing duct 150. A single fuel injector 160 is provided to supply fuel into the upstream end 156 of the fuel and air mixing duct 150. The fuel injector 160 is supplied with fuel from a fuel manifold.

Figure 13:
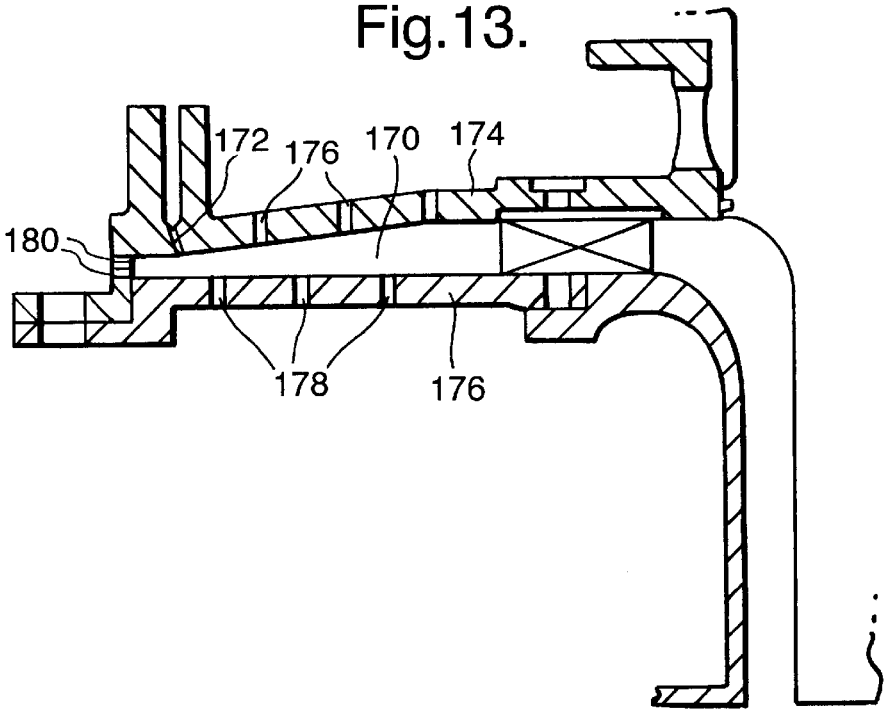
FIG. 13 is a cross-sectional view of an alternative fuel and air mixing duct.
Figure 15:
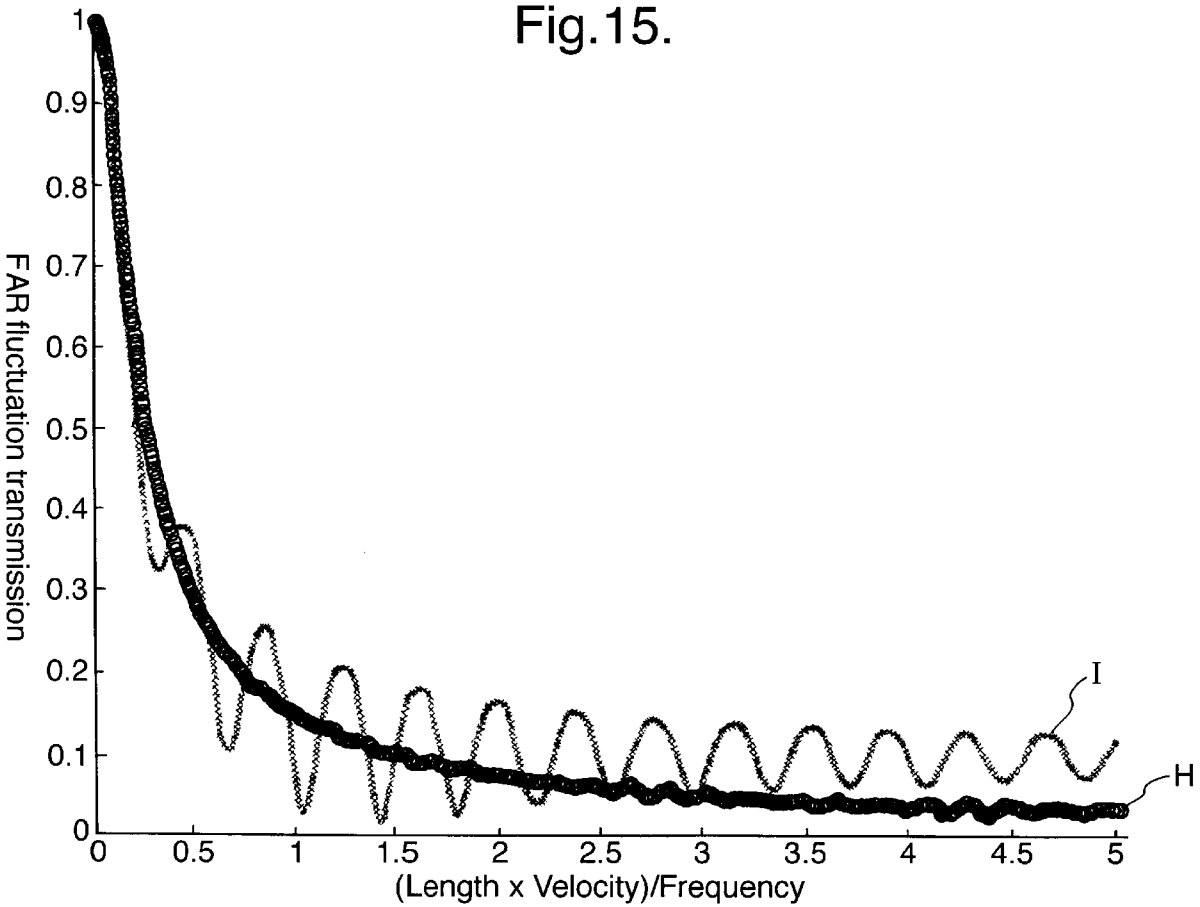
FIG. 15 is a graph of the fuel to air ratio of fuel and air mixing ducts according to the present invention against the frequency of the fluctuation multiplied by the length of the fuel and air mixing duct divided by the velocity of the fuel and air mixture leaving the fuel and air mixing duct.

Another primary fuel and air mixing duct 170 according to the present invention is shown in FIG. 13 and is similar to that shown in FIG. 3. The primary fuel and air mixing duct 170 comprises walls 174 and 176 which are provided with a plurality of radially, and circumferentially spaced apertures 176 and 178 respectively which form a primary air intake to supply air into the primary fuel and air mixing duct 170. The primary fuel and air mixing duct 170 also has a plurality of fuel injectors 172 positioned in the primary fuel and air mixing duct 170 upstream of the apertures 176 and 178. Additionally a plurality of circumferentially spaced apertures 180 are provided to form part of the primary air intake upstream of the fuel injectors 172. The apertures 180 supply up to 10% of the primary air flow upstream of the injectors 172. The apertures 180 are provided to prevent the formation of a stagnant zone, a zone with no net velocity, at the upstream end of the primary fuel and air mixing duct 170. The stagnant zone mainly consists of fuel and a small fraction of air, in operation, which results in long residence times for the fuel with an increased risk of auto ignition of the fuel in the primary fuel and air mixing duct 170. The apertures 180 minimise the risk of auto ignition. The primary fuel and air mixing duct 170 also increases on cross-sectional area as shown in a downstream direction. The introduction of air upstream of the fuel injectors only has a minor effect on the fuel to air ratio as shown in FIG. 15, where line H indicates the fuel to air ratio in FIG. 3 and line I indicates the fuel to air ratio in FIG. 13.

Figure 14:
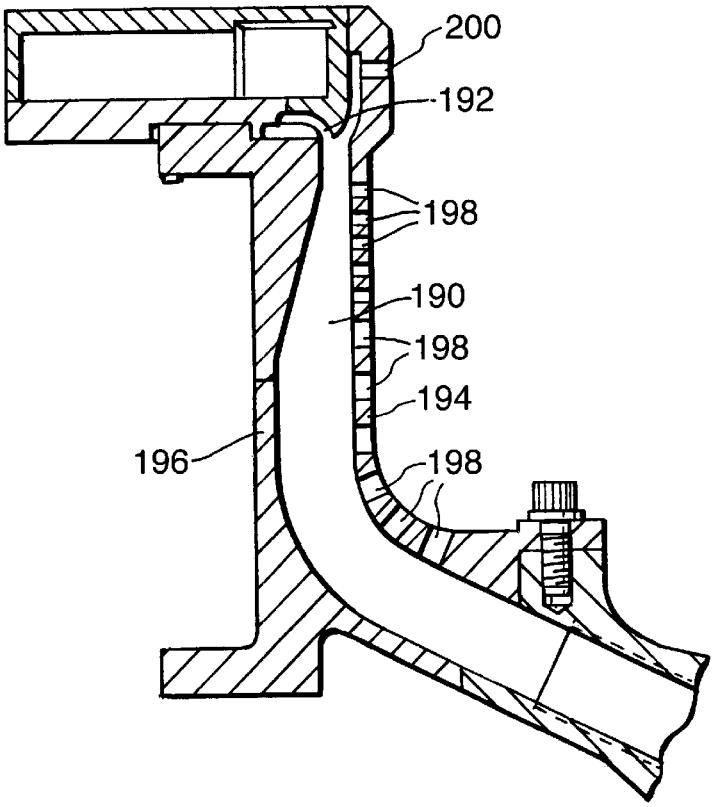
FIG. 14 is a cross-sectional view of a further fuel and air mixing duct.

A further secondary fuel and air mixing duct 190 according the present invention is shown in FIG. 14 and is similar to that shown in FIG. 4. The secondary fuel and air mixing duct 190 comprises inner annular wall 194 and outer annular wall 196. The inner annular wall 192 is provided with a plurality of axially, and circumferentially, spaced apertures 198 which form a secondary air intake to supply air into the secondary fuel and air mixing duct 190. The secondary fuel and air mixing duct 190 also has an annular fuel injector slot 192 positioned in the secondary fuel and air mixing duct 190 upstream of the apertures 198. Additionally a plurality of circumferentially spaced apertures 200 are provided to form part of the secondary air intake upstream of the fuel injector slot 192. The apertures 200 supply up to 10% of the secondary air flow. These apertures 200 also prevent the formation of a stagnant zone and auto ignition, at the upstream end of the secondary fuel and air mixing duct 190. The secondary fuel and air mixing duct 190 also increases in cross-sectional area as shown in a downstream direction. A similar arrangement of additional apertures may be applied to the tertiary fuel and air mixing duct to prevent the formation of a stagnant zone and auto ignition.

The apertures in the walls of the fuel and air mixing duct may be circular, elongate for example slots, or any other suitable shape. The apertures in the walls of the fuel and air mixing duct may be arranged perpendicularly to the walls of the fuel and air mixing duct or at any other suitable angle.

The fuel supplied by the fuel injector may be a liquid fuel or a gaseous fuel.

The invention is also applicable to other fuel and air mixing ducts. For example the fuel and air mixing ducts may comprise any suitable shape, or cross-section, as long as there are a plurality of points of injection of air spaced apart longitudinally, in the direction of flow through the fuel and air mixing duct, into the fuel and air mixing duct. The apertures may be provided in any one or more of the walls defining the fuel and air mixing duct.

The invention is also applicable to other air injectors, for example hollow perforate members may be provided which extend into the fuel and air mixing duct to supply air into the fuel and air mixing duct.

The fuel and air mixing duct may have a swirler, alternatively it may not have a swirler. The fuel and air mixing duct may have two coaxial counter swirling swirlers. The swirler may be an axial flow swirler.

Although the invention has referred to an industrial gas turbine engine it is equally applicable to an aero gas turbine engine or a marine gas turbine engine.

We claim:

1. A combustion chamber comprising at least one combustion zone defined by at least one peripheral wall, at least one fuel and air mixing duct for supplying a fuel and air mixture to the at least one combustion zone, the at least one fuel and air mixing duct having an upstream end and a downstream end, fuel injection means for supplying fuel into the at least one fuel and air mixing duct, air injection means for supplying air into the at least one fuel and air mixing duct, the pressure of the air supplied to the at least one fuel and air mixing duct fluctuating, the air injection means comprising a plurality of air injectors spaced apart in the direction of flow through the at least one fuel and air mixing duct to reduce the magnitude of the fluctuations in the fuel to air ratio of the fuel and air mixture supplied into the at least one combustion zone, the fuel and air mixing duct having a volume and a length, the injectors being spaced apart to Progressively introduce air into the fuel and air mixing ducts along the length of the fuel and air mixing duct to integrate out the fluctuations in the fuel to air ratio, the volume of the fuel and air mixing duct being selected so that the average travel time from the fuel injecting means to the downstream end of the fuel and air mixing duct is greater than the time period of the fluctuation, the volume of the fuel and air mixing duct being such that the length thereof is at least two multiplied by the velocity of the fuel and air mixture leaving the downstream end of the fuel and air mixing duct divided by the frequency of the fluctuations and wherein the at least one fuel and air mixing duct comprises a single annular fuel and air mixing duct, the air injection means being axially spaced apart.

2. A combustion chamber as claimed in claim 1 wherein the annular fuel and air mixing duct comprises an inner annular wall and an outer annular wall, the air injection means being provided in at least one of the inner and outer annular walls.

3. A combustion chamber as claimed in claim 2 wherein the air injection means are arranged in the inner and outer annular walls.

4. A combustion chamber comprising at least one combustion zone defined by at least one peripheral wall, at least one fuel and air mixing duct for supplying a fuel and air mixture to the at least one combustion zone, the at least one fuel and air mixing duct having an upstream end and a downstream end, fuel injection means for supplying fuel into the at least one fuel and air mixing duct, air injection means for supplying air into the at least one fuel and air mixing duct, the pressure of the air supplied to the at least one fuel and air mixing duct fluctuating, the air injection means comprising a plurality of air injectors spaced apart in the direction of flow through the at least one fuel and air mixing duct to reduce the magnitude of the fluctuations in the fuel to air ratio of the fuel and air mixture supplied into the at least one combustion zone, the fuel and air mixing duct having a volume and a length, the injections being spaced apart to progressively introduce air into the fuel and air mixing ducts along the length of the fuel and air mixing duct to integrate out the fluctuations in the fuel to air ratio, the volume of the fuel and air mixing duct being selected so that the average travel time from the fuel injecting means to the downstream end of the fuel and air mixing duct is greater than the time period of the fluctuation, the volume of the fuel and air mixing duct being such that the length thereof is at least two multiplied by the velocity of the fuel and air mixture leaving the downstream end of the fuel and air mixing duct divided by the frequency of the fluctuations and wherein the fuel and air mixing duct comprises a radial fuel and air mixing duct, the air injection means being radially spaced apart.

5. A combustion chamber as claimed in claim 4 wherein the radial fuel and air mixing duct comprises a first radial wall and a second radial wall, the air injection means being provided in at least one of the first and second radial walls.

6. A combustion chamber as claimed in claim 5 wherein the air injection means are provided in the first and second radial walls.

7. A combustion chamber as claimed in claim 1 wherein the fuel injection means is arranged at the upstream end of the fuel and air mixing duct and the air injection means are arranged downstream of the fuel injector means.

8. A combustion chamber as claimed in claim 1 wherein the at least one fuel and air mixing duct comprises a swirler.

9. A combustion chamber as claimed in claim 8 wherein the swirler is a radial flow swirler.

10. A fuel and air mixing duct for a combustion chamber, the fuel and air mixing duct comprising fuel injection means for supplying fuel into the fuel and air mixing duct, air injection means for supplying air into the fuel and air mixing duct, the air injection means comprising a plurality of air injections spaced apart in the direction of flow through the fuel and air mixing duct and where the fuel and air mixing duct has a volume and a length, the injectors being spaced apart to progressively introduce air into the fuel and air mixing ducts along the length of the fuel and air mixing duct to integrate out the fluctuations in the fuel to air ratio, the volume of the fuel and air mixing duct being selected so that the average travel time from the fuel injection means to the downstream end of the fuel and air mixing duct is greater than the time period of the fluctuation, the volume of the fuel and air mixing duct being such that the length thereof is at least two multiplied by the velocity of the fuel and air mixture leaving the downstream end of the fuel and air mixing duct divided by the frequency of the fluctuations.

* * * * *